US008448723B2

(12) United States Patent
Crawford et al.

(10) Patent No.: US 8,448,723 B2
(45) Date of Patent: May 28, 2013

(54) SEAL ASSEMBLY FOR DRILL BIT

(75) Inventors: Micheal Burl Crawford, Montgomery, TX (US); Pele Jason Nunley, Mansfield, TX (US); Richard August Flak, Mansfield, TX (US)

(73) Assignee: Burintekh USA, LLC, Fort Worth, TX (US)

( * ) Notice: Subject to any disclaimer, the term of this patent is extended or adjusted under 35 U.S.C. 154(b) by 757 days.

(21) Appl. No.: 12/307,820

(22) PCT Filed: Aug. 2, 2007

(86) PCT No.: PCT/US2007/075105
§ 371 (c)(1),
(2), (4) Date: Dec. 7, 2009

(87) PCT Pub. No.: WO2008/019293
PCT Pub. Date: Feb. 14, 2008

(65) Prior Publication Data

US 2011/0315453 A1 Dec. 29, 2011

Related U.S. Application Data

(60) Provisional application No. 60/834,864, filed on Aug. 2, 2006.

(51) Int. Cl.
*E21B 10/00* (2006.01)

(52) U.S. Cl.
USPC ..... 175/371; 175/372; 175/354

(58) Field of Classification Search
USPC ..... 175/371, 372, 354, 359; 384/94; 277/500, 277/584, 586
See application file for complete search history.

(56) References Cited

U.S. PATENT DOCUMENTS

| | | | | |
|---|---|---|---|---|
| 4,428,687 | A * | 1/1984 | Zahradnik | 384/94 |
| 4,494,749 | A * | 1/1985 | Evans | 277/309 |
| 5,040,624 | A * | 8/1991 | Schumacher et al. | 175/371 |
| 6,033,117 | A * | 3/2000 | Cariveau et al. | 384/94 |
| 6,247,545 | B1 * | 6/2001 | Burr et al. | 175/371 |

* cited by examiner

*Primary Examiner* — David Andrews
*Assistant Examiner* — Ronald Runyan
(74) *Attorney, Agent, or Firm* — Winstead PC

(57) ABSTRACT

A drill bit includes a floating journal bushing, a seal, a cutter having a seal gland for the seal and a cutter bearing surface proximate to the journal bearing, wherein the cutter bearing surface has a first inner diameter, and a journal, wherein the cutter is rotatably coupled about the journal, wherein the cutter is rotatably coupled about the journal, wherein the journal bearing is rotatably coupled about the journal, wherein the journal has a seal boss having a first diameter, and a journal bearing surface having a second diameter, and wherein the first diameter is less than the first inner diameter.

11 Claims, 7 Drawing Sheets

SEAL ASSEMBLY FOR DRILL BIT

RELATED APPLICATIONS

This application claims the benefit of U.S. Provisional Patent Application No. 60/834,864 filed Aug. 2, 2006.

FIELD OF THE INVENTION

This invention relates in general to earth-boring bits for use in a downhole environment, and, more specifically, to a seal assembly for a earth boring bit.

BACKGROUND

One of the important types of rotary drill bits in the petroleum business is the roller cone bit. As the drill bit rotates, the applied weight-on-bit ("WOB") forces the downward pointing teeth of the rotating cones into the formation being drilled. Thus the points of the teeth apply a compressive stress which exceeds the yield stress of the formation, and this induces fracturing. The resulting fragments are flushed away from the cutting face by the drilling fluid or mud.

Roller cone-type bits typically include bearings, such as ball bearings, roller bearings, or more simply journal bearings. A seal, such as an elastomeric seal, is typically used between the bearings and the outside environment to keep lubricant around the bearings and to keep contamination out. In a rotary seal, where one surface rotates around another, some special considerations are important in the design of both the seal itself and the seal gland into which it is seated. For instance, the elastomeric seal should be under compressive (as opposed to tensile) stress, and while there should be enough pressure between the seal and the rotating surface to prevent leakage, the pressure should be minimized to reduce friction and wear.

The constraints on the seals used in downhole applications are different from those of other low-speed sealing applications in several respects. First, everything in a bit, which operates deep in the earth, must be extremely robust to withstand the pressure and eccentric motion to which the bits are subjected. Additionally, the seals are themselves exposed to abrasive materials from two sources: not only does the drilling fluid near the cutting face include a heavy load of abrasive material (which is moving very turbulently at very high velocities), but the bearings themselves, as they wear, will tend to produce metal particles, and these metal particles themselves may be abrasive to a soft seal. Thus, both sides of the seal should ideally be protected from these abrasive effects. Additionally, the bit is operating in a remote environment from which it may take hours to retrieve for replacement, so it is highly desirable to have the bit operate for as long as possible.

One problem with conventional drill bit seals is that, as the bit is operated, the seal will inevitably wear, so that less compressive force is applied against the moving surface, running the risk that a leak will develop across the seal. Therefore, it is a desire to provide a seal assembly of a earth boring bit that protects the seal and improves bit performance.

SUMMARY OF THE INVENTION

A rotary seal assembly for a drill bit, such as a roller cone drill bit, is provided. In one embodiment, a drill bit includes a floating journal bushing, a seal, a cutter having a seal gland for the seal and a cutter bearing surface proximate to the journal bearing, wherein the cutter bearing surface has a first inner diameter, and a journal, wherein the cutter is rotatably coupled about the journal, wherein the floating journal bushing is rotatably coupled about the journal, wherein the journal includes a seal boss having a first diameter, and a journal bearing surface having a second diameter, and wherein the first diameter is less than the first inner diameter.

In another embodiment, a drill bit includes a journal bearing, a seal, a cutter having a seal gland for the seal and a cutter bearing surface proximate to the journal bearing, wherein the cutter bearing surface comprises a first inner diameter, a cutter bearing surface extension positioned adjacent to the cutter bearing surface and proximate to the journal bearing, and a journal, wherein the cutter is rotatably coupled about the journal and wherein the journal bearing is rotatably coupled about the journal.

In another embodiment, a drill bit includes a journal bearing, a seal, a cutter having a seal gland for the seal and a cutter bearing surface proximate to the journal bearing, wherein the cutter bearing surface has a first inner diameter, a journal, wherein the cutter is rotatably coupled about the journal and wherein the journal bearing is rotatably coupled about the journal, and wherein the seal gland has a first cavity for the seal and a second cavity proximate to the seal.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

Figure 1:
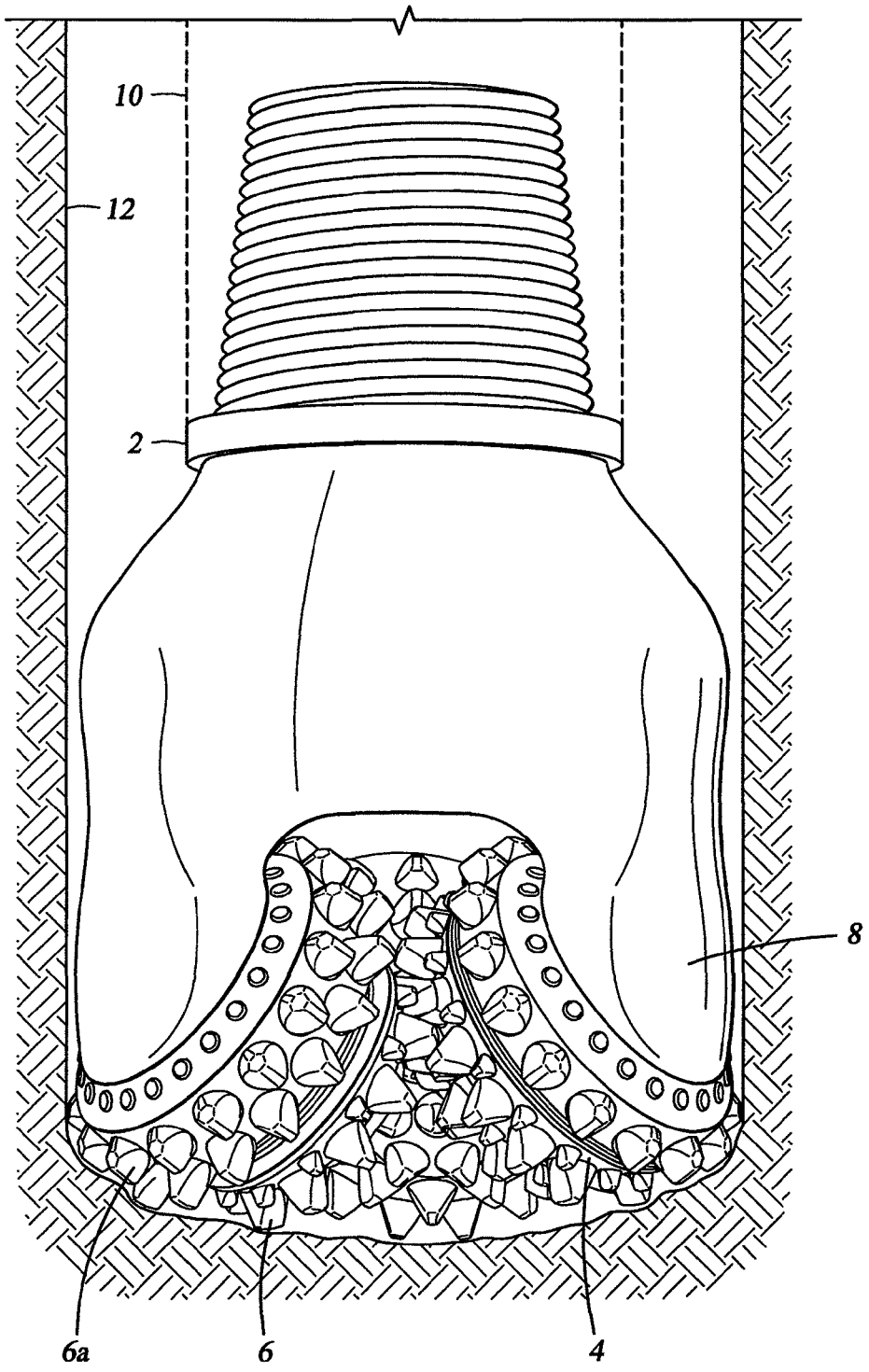
FIG. 1 shows a schematic drawing in elevation of a rotary cone drill bit with journal arms that may be used in conjunction with the seal assembly of the present invention.

Refer now to the drawings wherein depicted elements are not necessarily shown to scale and wherein like or similar elements are designated by the same reference numeral through the several views.

As used herein, the terms "up" and "down"; "upper" and "lower"; "uphole" and "downhole" and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The present invention is directed to a seal assembly for an earth-boring bit, such as a roller cone bit. In one embodiment, the seal assembly may increase seal coverage, and shirttail length, while reducing seal surface speed. The seal assembly may increase the life span of the seal to improve drill bit performance and reliability. In another embodiment, the seal assembly may provide greater bearing surface, longer bearing sleeve and improves bearing load capacity.

FIG. 1 shows a roller cone bit suitable to be used in conjunction with an embodiment of the seal assembly of the present invention, indicated generally by 2. Roller cone bit 2 is positioned into formation 12 by drill string 10. Roller cone bit 2 includes rotating cutter cones 4 having cutters 6 and gage cutters 6*a* on their outer surfaces. Cutter cones 4 are mounted on arms 8. Although a roller cone bit is described herein, one of ordinary skill in the art will recognize that the seal assembly of the present invention may be used with other types of earth boring bits.

Figure 2:
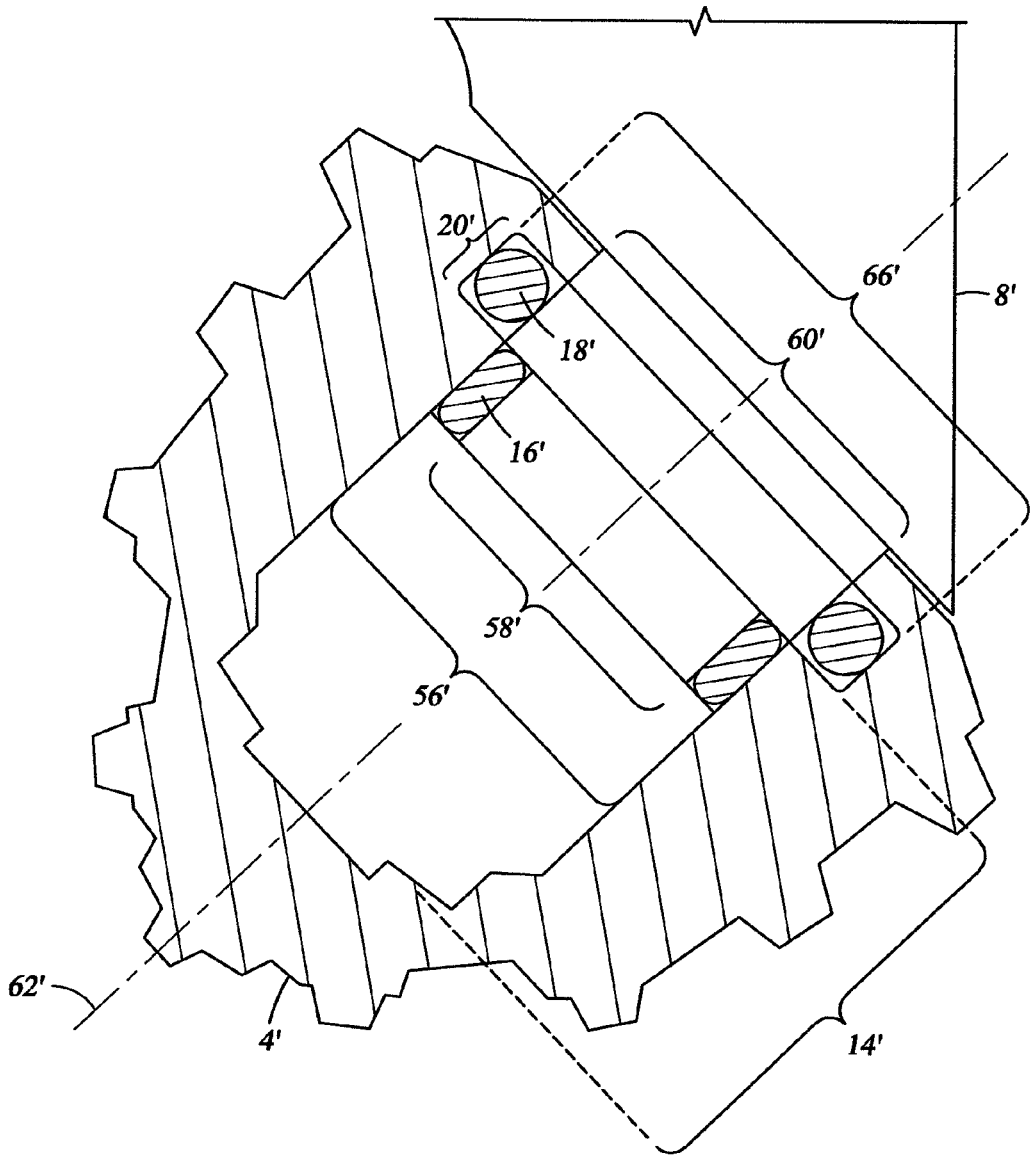
Fig. 2 (PRIOR ART)
FIG. 2 shows a cross section view of a prior art cone drill bit, showing the seal and seal gland.

FIG. 2 shows a cross section view of a portion of a prior art cutter cone 4'. Cutter cone 4' includes journal 14' mounted on arm 8', floating journal bushing 16', seal 18' and seal gland 20'. Cutter cone 4' and journal 14' rotate about central axis 62'. Cutter cone 4' has a first cutter inner diameter 56' about floating journal bushing 16'. Journal 14' has a first outer diameter 60' proximate seal 18'. Journal 14' has a second outer diameter 58' proximate floating journal bushing 16'.

Figure 3:
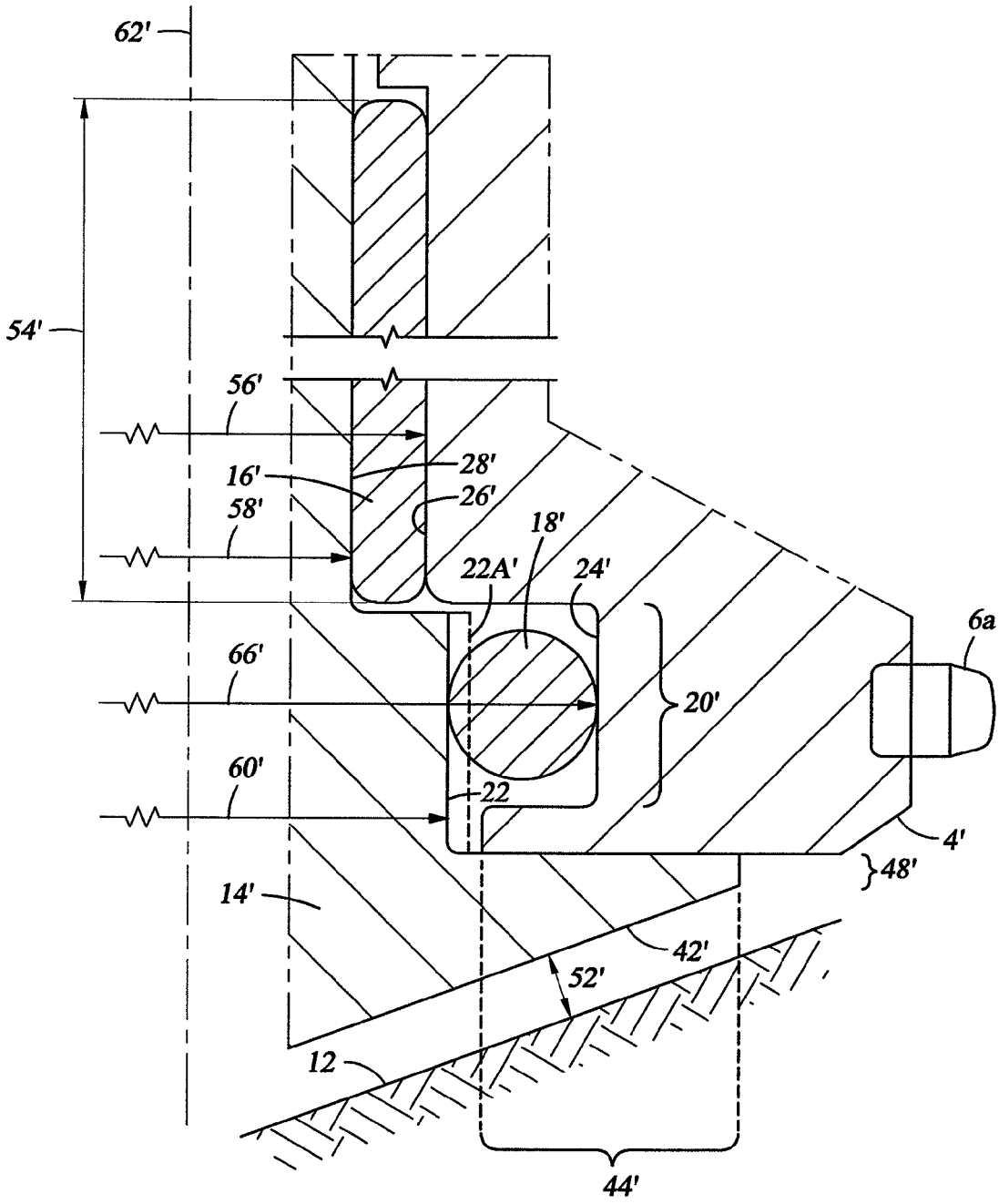
Fig. 3 (PRIOR ART)
FIG. 3 shows a detail view of the prior art cutter cone.

FIG. 3 shows a detail view of prior art cutter cone 4'. Seal 18' is positioned within seal gland 20', an annular groove defined by the space between cutter seal surface 24' of cutter cone 4' and seal boss 22' of journal 14'. Floating journal bushing 16' is positioned between cutter bearing surface 26' and journal bearing surface 28'. In the prior art seal assembly, seal boss 22' is either substantially aligned with cutter bearing surface 26' or, as indicated in phantom by 22*a*', extends beyond cutter bearing surface 26' and further into seal gland 20'. In other words, first journal outer diameter 60' is equal to or greater than first cutter inner diameter 56'.

Figure 4:
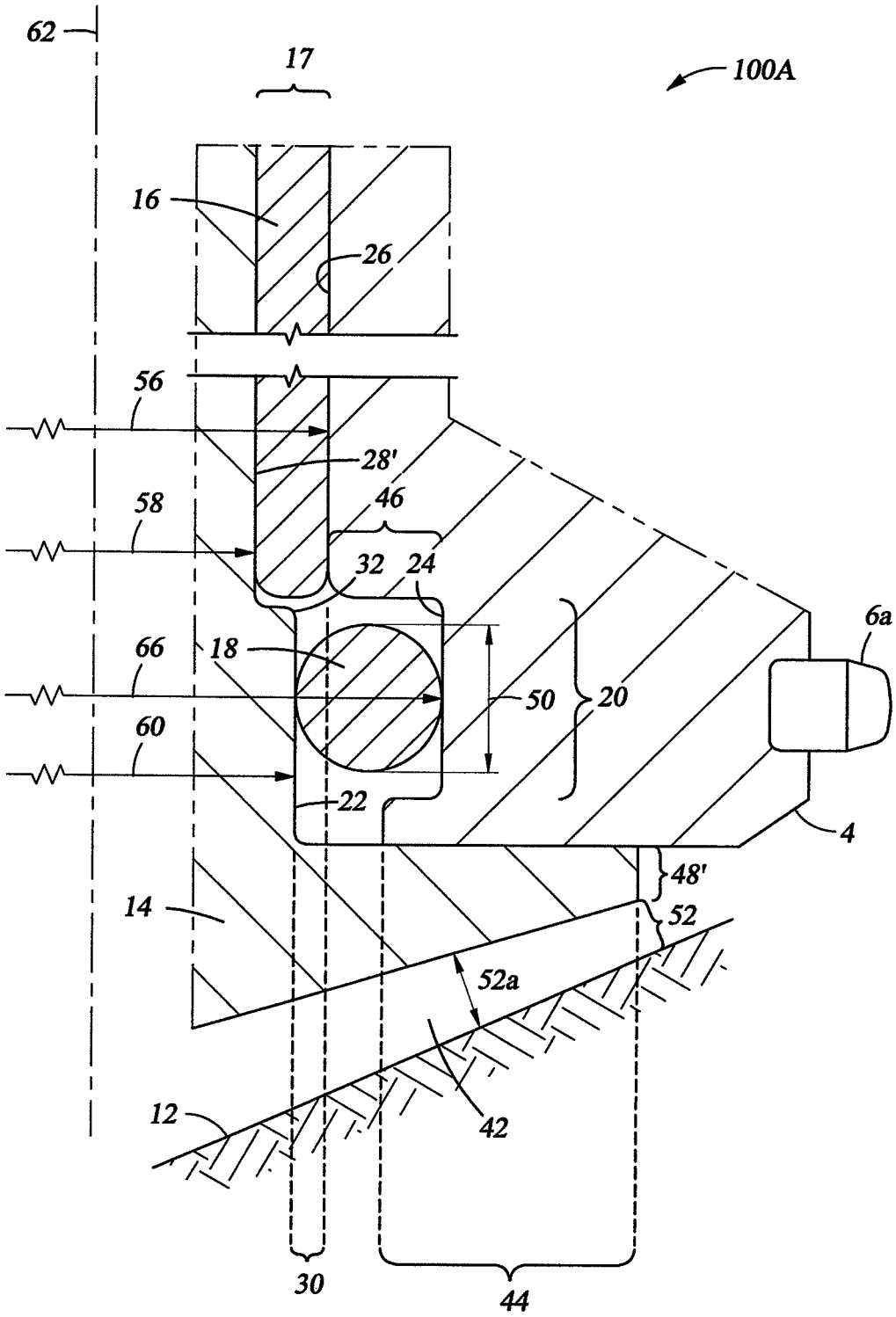
FIG. 4 shows an embodiment of the seal assembly of the present invention.

FIG. 4 shows an embodiment of the seal assembly of the present invention, indicated by 100*a*. FIG. 4 shows a cross section view of a portion of cutter cone 4 and journal 14. Seal 18 is positioned within seal gland 20, shown as an annular groove or cavity defined by the space between cutter seal surface 24 of cutter cone 4 and seal boss 22 of journal 14. Seal 18 may be an annular seal or O-ring seal, for example. Floating journal bushing 16 is positioned between cutter bearing surface 26 and journal bearing surface 28. In this embodiment of seal assembly 100, seal boss 22 is offset from cutter bearing surface 26 by a selected seal boss offset 30. In other words, the first journal outer diameter 60 is less than first cutter inner diameter 56. Stated differently, the floating journal bushing 16 is not fully captured on seal boss 22. Bushing flange 32 is positioned between journal bearing surface 28 and seal boss 22. Bushing flange 32 may keep floating journal bushing 16 in place between journal bearing surface 28 and cutter bearing surface 26. The amount of seal boss offset 30 or bushing flange 32 may vary based on the size of drill bit 2 or the size of floating journal bushing 16 (e.g., width 17 of floating journal bushing 16). For example, for an average sized roller cone drill bit 2, with a bit diameter of about 7⅞ inches to about 8¾ inches, bushing flange 32 may be in a range from about 0.02 inches to about 0.03 inches. For example, on a smaller sized roller cone drill bit 2 where floating journal bushing 16 is about 0.04 inches thick, bushing flange 32 may be in a range from about 0.015 inches to about 0.02 inches. For larger bits 2, where floating journal bushing 16 may be about 0.12 inches thick, bushing flange 32 may be in a range from about 0.03 inches to about 0.04 inches. In the embodiment shown in FIG. 4, for example, bushing flange 32 is about 25% to about 75% of the width of floating journal bushing 16. Those of ordinary skill in the art will recognize that bushing flange 32 may range from any selected percentage of the width 17 of floating journal bushing 16.

Seal boss offset 30 allows the seal gland 20 to have a smaller inner diameter or width 46. other words, width 46 is smaller than width 46' (shown in FIG. 3) by about the distance of seal boss offset 30. This savings in space directly translates to a corresponding increase in shirttail coverage 44, off wall of hole distance 52, or both (in comparison to shirttail coverage 44' or off wall of hole distance 52'). Alternatively, or in addition, seal boss offset 30 may allow an increase in shirttail thickness 48 (in comparison to shirttail thickness 48' shown in FIG. 3). For example, shirttail coverage 44*a* and shirttail thickness 48*a* may be selected to provide off wall of hole distance 52*a* (where distance 52*a* is greater than distance 52).

Shirttail coverage 44, off wall of hole distance 52 and shirttail thickness 48 correspond to the protection provided to seal 18 during operation. Accordingly, seal boss offset 30 may improve seal protection, which extends seal life, which provides more reliable operation for drill bit 2. In addition, seal boss offset 30 decreases the seal boss diameter 60 which reduces seal speed, which, in turn, may increase seal life because the reduced seal boss diameter 60 means less distance traveled for the seal 18, e.g., seal 18 has a smaller outer diameter 66 than the outer diameter 66' of seal 18' shown in FIGS. 2 and 3. Seal 18 may have the same seal cross section width 50 as the seal cross section width 50' of seal 18' shown in FIG. 3. Seal boss offset 30 allows for configurations of shirttail coverage 44, shirttail thickness 48, and off wall of hole distance 52 that balance seal protection and drill bit performance.

Figure 5:
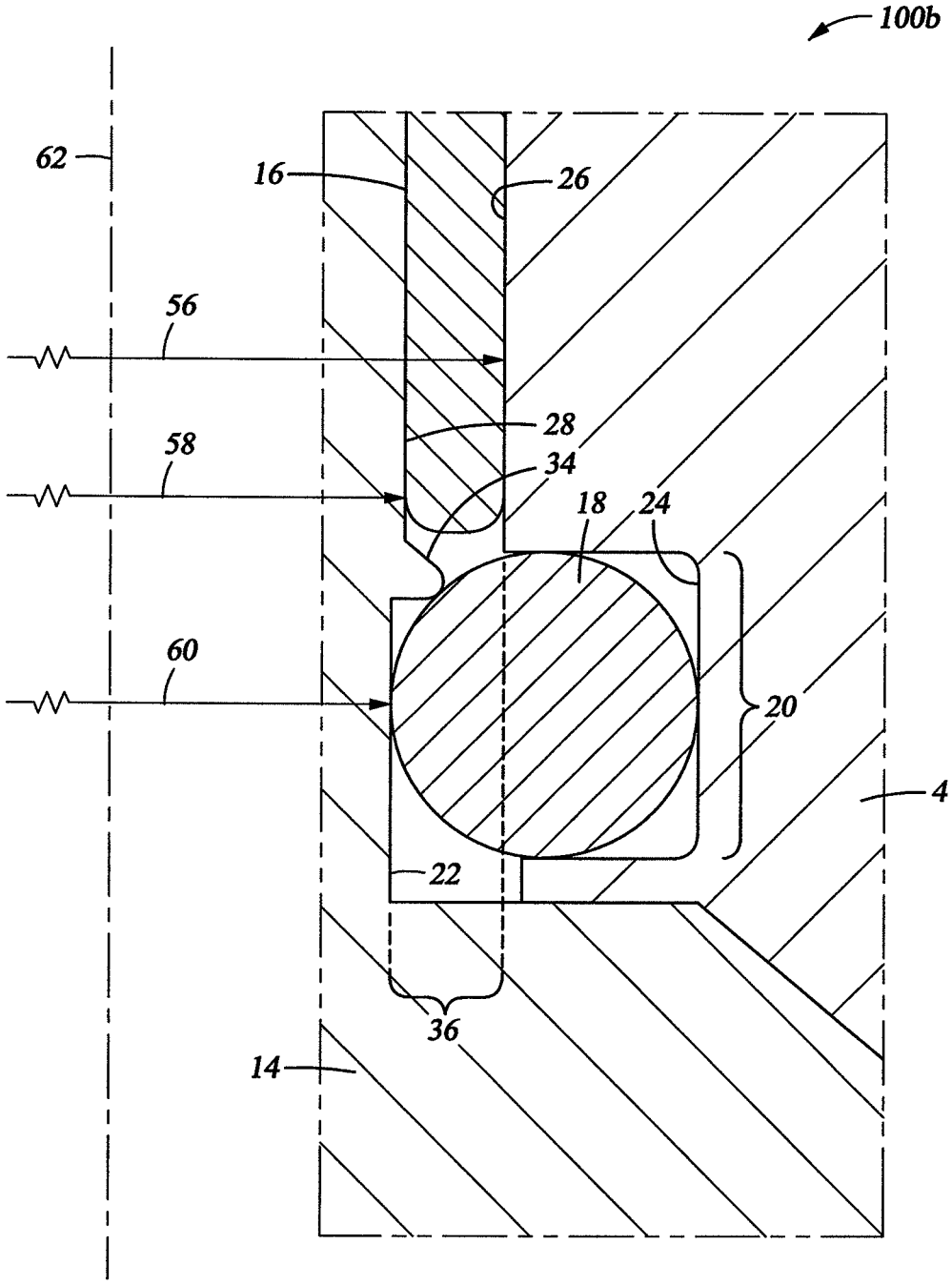
FIG. 5 shows another embodiment of the seal assembly of the present invention.

FIG. 5 shows another embodiment of the seal assembly 100*b*. In this embodiment, seal boss 22 is offset from cutter bearing surface 26 by a selected seal boss offset 36, beyond journal bearing surface 28, e.g., seal boss offset 36 is larger than seal boss offset 30 (shown in FIG. 4). In other words, the outer diameter 60 of journal 14 in the region proximate seal gland 20 is smaller that the outer diameter 58 of journal 14 in the region proximate to floating journal bushing 16. Bushing flange 34 is positioned between journal bearing surface 28 and seal boss 22 to keep floating journal bushing 16 in place between journal bearing surface 28 and cutter bearing surface 26.

Figure 6:
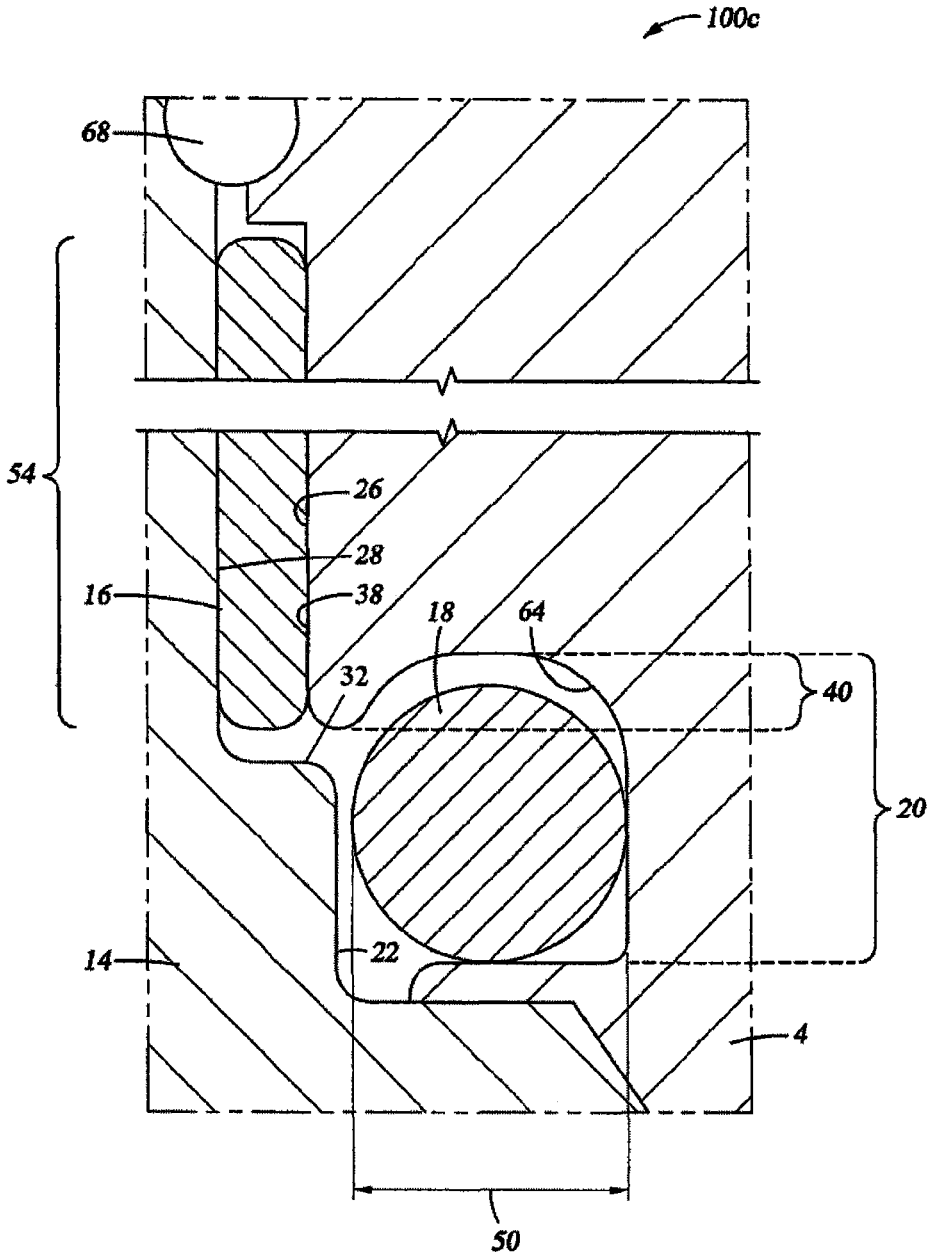
FIG. 6 shows yet another embodiment of the seal assembly of the present invention.

FIG. 6 shows yet another embodiment of the seal assembly 100*c* (that may be used in conjunction with seal assembly 100*a* or 100*b*). Bushing flange 32 may keep floating journal bushing 16 in place between journal bearing surface 28 and cutter bearing surface 26. Cutter bearing surface extension 38 is positioned adjacent to cutter bearing surface 26 and extends the surface of cutter bearing surface 26 by length 40. Cutter bearing surface extension 38 may comprise a lip, or similar structure, about seal gland 20. Seal gland 20 may include a second cavity 64 within cutter 4 and proximate to cutter bearing surface 26. As shown in FIG. 6, second cavity 64 is shaped to provide cutter bearing surface extension 38. Second cavity 64 may limit seal extrusion, confine or anchor seal 18 within seal gland 20, provide an area for lubricant, or provide other benefits in addition to providing cutter bearing surface extension 38.

Figure 7:
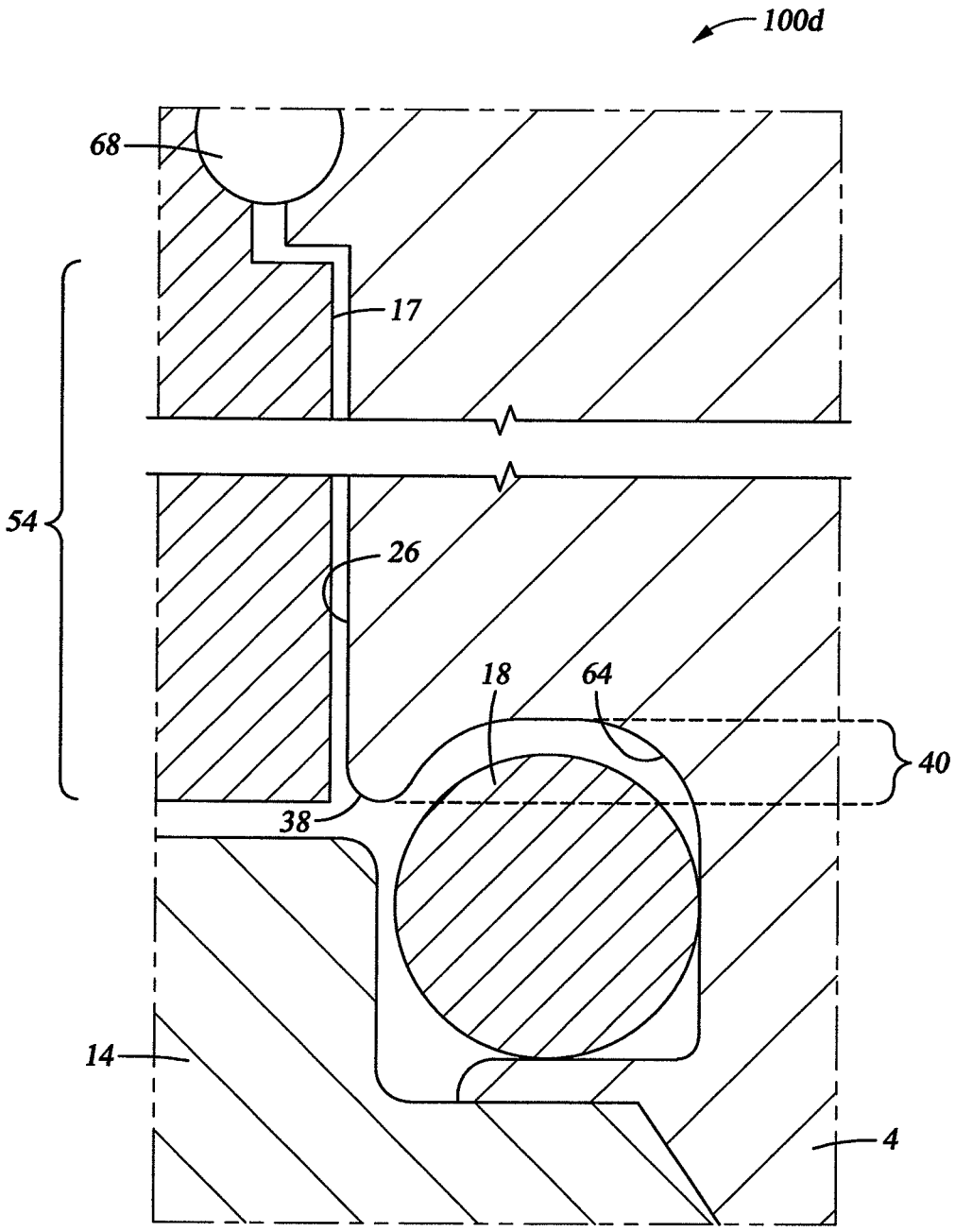
FIG. 7 shows a further embodiment of the seal assembly of the present invention.

Length 40 may be proportional to the seal cross section width 50. For example, in some embodiments, length 40 may be about 1% to about 50% of seal cross section width 50 (either confined or unconfined). By extending the effective surface of cutter bearing surface 26, drill bit 2 may include a floating journal bushing 16 with a larger height 54, i.e., height 54 is larger than height 54' by about length 40. This increase in the height of floating journal bushing 16 corresponds to an increase in the load bearing surface of the journal 14, which, in turn, increases the load carrying capacity of drill bit 2, e.g., the load carrying capacity is directly proportional to the length from ball race 68 to seal gland 20. In addition, a longer floating journal bushing 16 may be more stable and run at cooler temperatures, among other factors that may increase the lifespan of floating journal bushing 16 and provide more reliable operation for drill bit 2. Cutter bearing surface extension 38 may also limit or prevent seal extrusion. FIG. 7 shows another embodiment of the seal assembly 100*d* where drill bit 2 includes non-bushing bearing 17 instead of a floating journal bushing.

From the foregoing detailed description of specific embodiments of the invention, it should be apparent that a seal assembly for a drill bit that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A drill bit comprising a floating journal bushing;

a seal;

a cutter comprising a seal gland for the seal and a cutter bearing surface proximate to the floating journal bushing, wherein the cutter bearing surface comprises a first cutter inner diameter, wherein the cutter bearing surface further comprises a cutter bearing surface extension, the cutter bearing surface extension comprises a lip positioned proximate to the seal gland, and wherein the seal comprises a seal cross section width and wherein a length of the cutter bearing surface extension is in a range from about 1% to about 50% of the seal cross section width;

a journal, wherein the cutter is rotatably coupled about the journal, wherein the floating journal bushing is rotatably coupled about the journal, wherein the journal comprises a seal boss having a first journal outer diameter, and a journal bearing surface having a second journal outer diameter, and wherein the first journal outer diameter is less than the first inner diameter; and a bushing flange positioned between the journal bearing surface and seal boss, wherein a length of the bushing flange is in a range from about 25% to about 75% of a width of the floating journal bushing.

2. The drill bit of claim 1, wherein the first journal outer diameter is less than the second journal outer diameter.

3. The drill bit of claim 1, wherein a length of the bushing flange is in a range from about 0.015 inches to about 0.04 inches.

4. The drill bit of claim 1, wherein the seal gland comprises a first cavity for the seal and a second cavity within a region of the cutter proximate to the cutter bearing surface.

5. The drill bit of claim 4, wherein the second cavity provides the cutter bearing surface extension.

6. A drill bit comprising a journal bearing, wherein the journal bearing is chosen from a non-bushing bearing and a floating journal bushing;

a seal;

a cutter comprising a seal gland for the seal and a cutter bearing surface proximate to the journal bearing, wherein the cutter bearing surface comprises a first cutter inner diameter;

a cutter bearing surface extension positioned adjacent to the cutter bearing surface and proximate to the journal bearing, wherein the cutter bearing surface extension comprises a lip positioned proximate to the seal gland, and the seal comprises a seal cross section width and wherein a length of the cutter bearing surface extension is in a range from about 1% to about 50% of the seal cross section width; and a journal, wherein the cutter is rotatably coupled about the journal and wherein the journal bearing is rotatably coupled about the journal, wherein the journal comprises a seal boss having a first journal outer diameter, and a journal bearing surface having a second journal outer diameter, wherein the first journal outer diameter is less than the first cutter inner diameter.

7. The drill bit of claim 6, wherein the seal gland comprises a first cavity for the seal and a second cavity within a region of the cutter proximate to the cutter bearing surface.

8. The drill bit of claim 7, wherein the second cavity provides the cutter bearing surface extension.

9. The drill bit of claim 6, wherein the journal bearing is a floating journal bushing; and wherein the journal further comprises a bushing flange positioned between the journal bearing surface and seal boss.

10. The drill bit of claim 9, wherein the first journal outer diameter is less than the second journal outer diameter.

11. The drill bit of claim 9, wherein a length of the bushing flange is in a range from about 25% to about 75% of a width of the floating journal bushing.

* * * * *

UNITED STATES PATENT AND TRADEMARK OFFICE

CERTIFICATE OF CORRECTION

PATENT NO. : 8,448,723 B2
APPLICATION NO. : 12/307820
DATED : May 28, 2013
INVENTOR(S) : Crawford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1153 days.

Signed and Sealed this
Eighth Day of September, 2015

Michelle K. Lee

Michelle K. Lee
*Director of the United States Patent and Trademark Office*